US006264349B1

(12) United States Patent
Morter

(10) Patent No.: US 6,264,349 B1
(45) Date of Patent: Jul. 24, 2001

(54) ADJUSTABLE LAMP

(76) Inventor: Howard G. Morter, 1598 Covered Bridge Rd., Cedarburg, WI (US) 53012

( * ) Notice: Subject to any disclaimer, the term of this patent is extended or adjusted under 35 U.S.C. 154(b) by 0 days.

(21) Appl. No.: 09/483,263

(22) Filed: Jan. 12, 2000

(51) Int. Cl.[7] ..... F21S 1/12
(52) U.S. Cl. ..... 362/413; 362/427; 362/431
(58) Field of Search ..... 362/401, 403, 362/410, 413, 414, 431, 285, 427

(56) References Cited

U.S. PATENT DOCUMENTS

| | | | | |
|---|---|---|---|---|
| 514,751 | | 2/1894 | Higbie | 248/297.51 |
| 641,748 | * | 1/1900 | Smith | 362/413 |
| 1,777,185 | * | 9/1930 | Thompson | 362/413 |
| 2,299,683 | * | 10/1942 | Curtis | 362/413 |
| 2,614,204 | | 10/1952 | Canfield | 240/2 |
| 3,160,755 | * | 12/1964 | Wolfe | 362/413 |
| 3,409,767 | * | 11/1968 | Entwistle | 362/401 |
| 3,707,625 | * | 12/1972 | Hustead | 362/410 |
| 4,463,413 | * | 7/1984 | Shirley | 362/401 |
| 4,908,982 | | 3/1990 | Quatrini | 47/39 |
| 4,953,715 | | 9/1990 | Celli | 211/37 |

* cited by examiner

*Primary Examiner*—Sandra O'Shea
*Assistant Examiner*—Peggy A Neils
(74) *Attorney, Agent, or Firm*—Donald J. Ersler

(57) ABSTRACT

An adjustable lamp includes a base, a pole, a cantilever member, a light bulb assembly, and a lamp shade. The pole is attached to the base. A pole opening is formed through substantially a first end of the cantilever member which is sized to slidably receive the pole. An assembly opening is preferably formed at a second end of the cantilever member for attaching the light bulb assembly to the cantilever member. The light bulb assembly preferably includes a light bulb socket, a light bulb, a spacer, and an electrical cord. The bottom of the light bulb socket is inserted through the spacer. A bottom of the light bulb socket is inserted through the assembly opening and fastened to the cantilever member. The light bulb is screwed into the light bulb socket. A lamp shade is attached to the adjustable lamp. The position of the light bulb is adjusted by lifting up the cantilever member, sliding the cantilever member to a desired position, and finally lowering thereof.

15 Claims, 4 Drawing Sheets

ADJUSTABLE LAMP

BACKGROUND OF THE INVENTION

1. Field of the Invention

The present invention relates generally to lamps and more specifically to an adjustable lamp which has a light bulb that may be moved to different heights and to different orientations without the need for tools or the untightening of a fastener.

2. Discussion of the Prior Art

There are numerous prior art lamps which allow the light bulb to be raised and lowered and rotated about a stationary post. However, these prior art lamps require the use of a tool or the unscrewing of a fastener to allow the light bulb to be moved.

Accordingly, there is a clearly felt need in the art for an adjustable lamp with a light bulb that may be adjusted for height and orientated without the need for tools or the untightening of a fastener.

SUMMARY OF THE INVENTION

The present invention provides a lamp which has a light bulb that may be adjusted to different heights and orientations without the use of tools or the unthreading of a fastener. According to the present invention, an adjustable lamp includes a base, a pole, a cantilever member, a light bulb assembly, and a lamp shade. The pole is attached to the base. A pole opening is formed through substantially a first end of the cantilever member which is sized to slidably receive the pole. An assembly opening is preferably formed at a second end of the cantilever member for attachment of the light bulb assembly to the cantilever member. The light bulb assembly preferably includes a light bulb socket, a light bulb, a spacer, and an electrical cord. The bottom of the light bulb socket is inserted through the spacer. A bottom of the light bulb socket is inserted through the assembly opening and fastened to the cantilever member. The light bulb is screwed into the light bulb socket. A lamp shade is attached to the light bulb or lamp socket, or adjustable lamp. The position of the light bulb is adjusted by lifting up the cantilever member, sliding the cantilever member to a desired position, and finally lowering thereof.

Accordingly, it is an object of the present invention to provide an adjustable lamp which has a light bulb that may be positioned at different heights or orientations without using tools or the untightening of a fastener.

These and additional objects, advantages, features and benefits of the present invention will become apparent from the following specification.

DETAILED DESCRIPTION OF THE PREFERRED EMBODIMENTS

Figure 1:
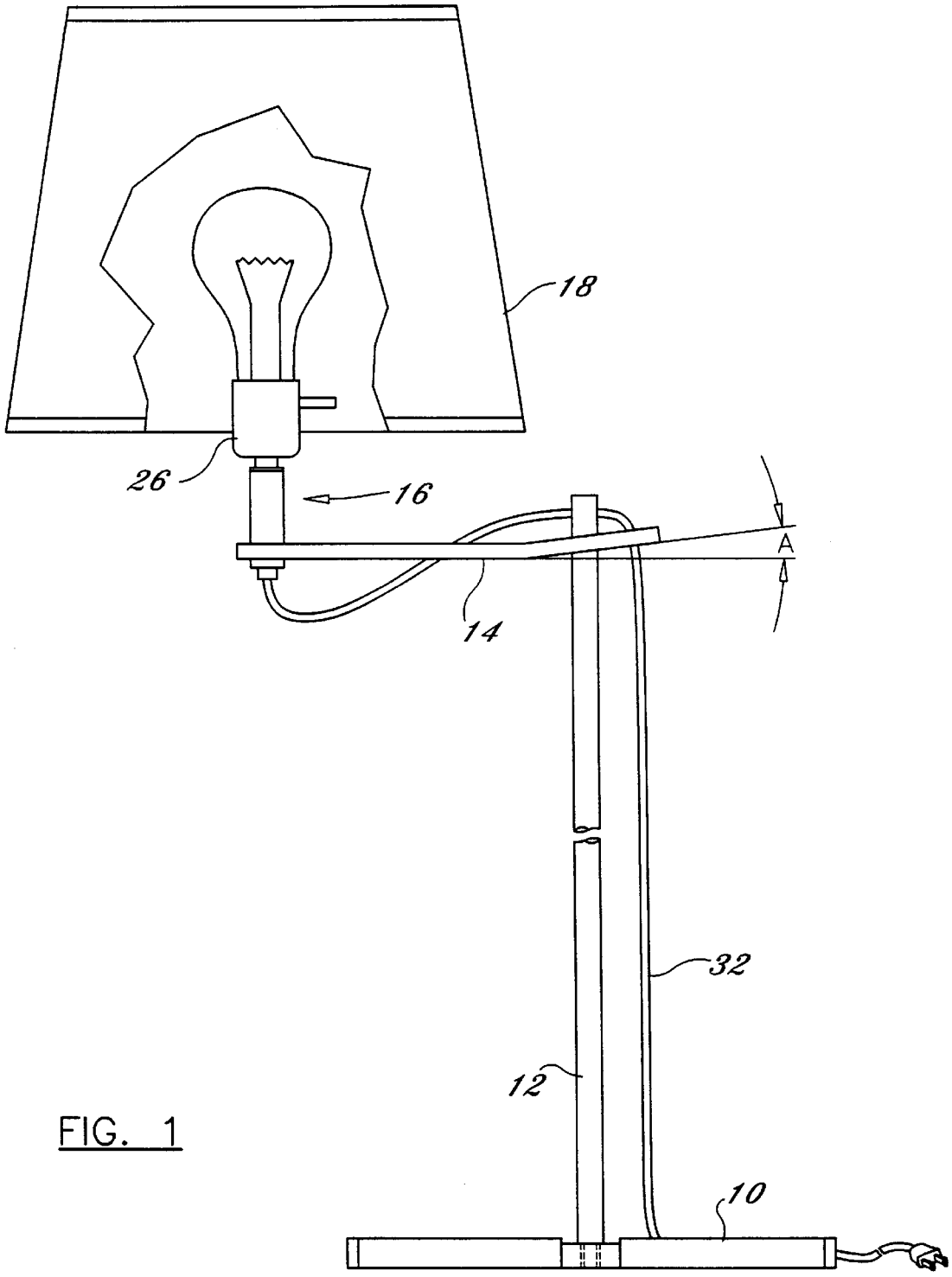
FIG. 1 is a front view of an adjustable lamp in accordance with the present invention.
Figure 2:
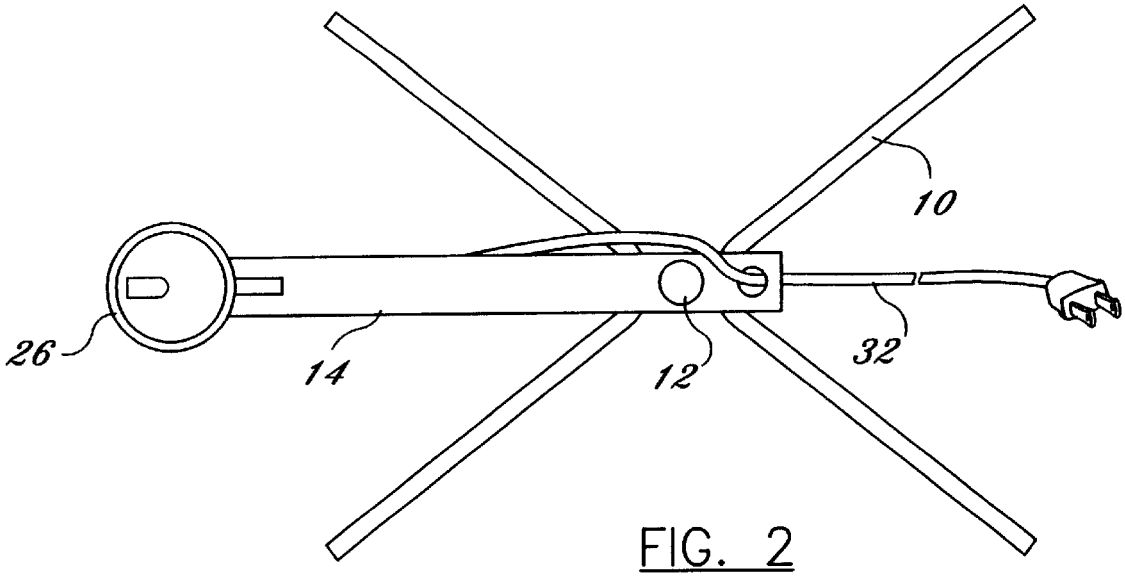
FIG. 2 is a top view of an adjustable lamp without a light bulb or lamp shade in accordance with the present invention.
Figure 3:
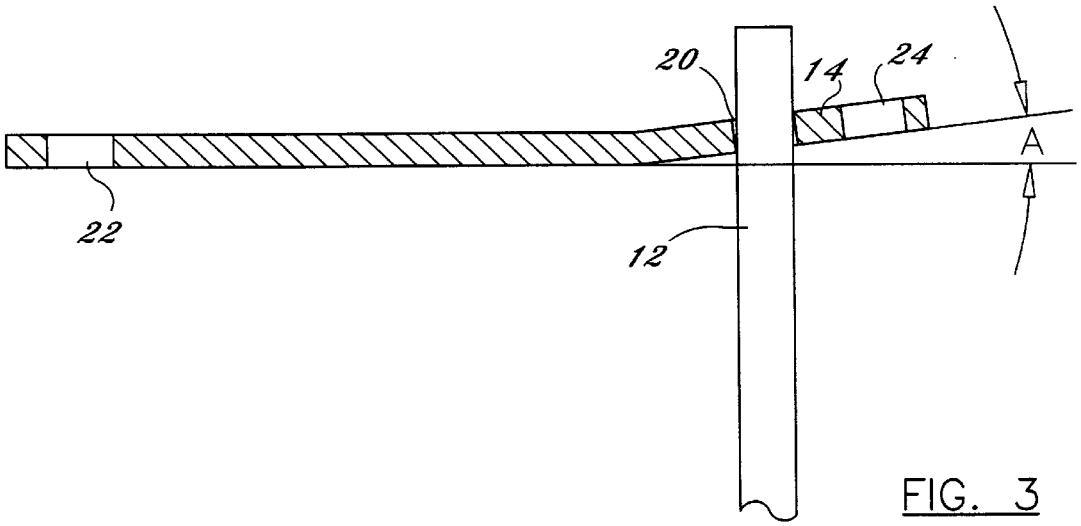
FIG. 3 is a partially enlarged view of a cantilever member with a pole inserted therethrough in a resting position in accordance with the present invention.
Figure 3A:
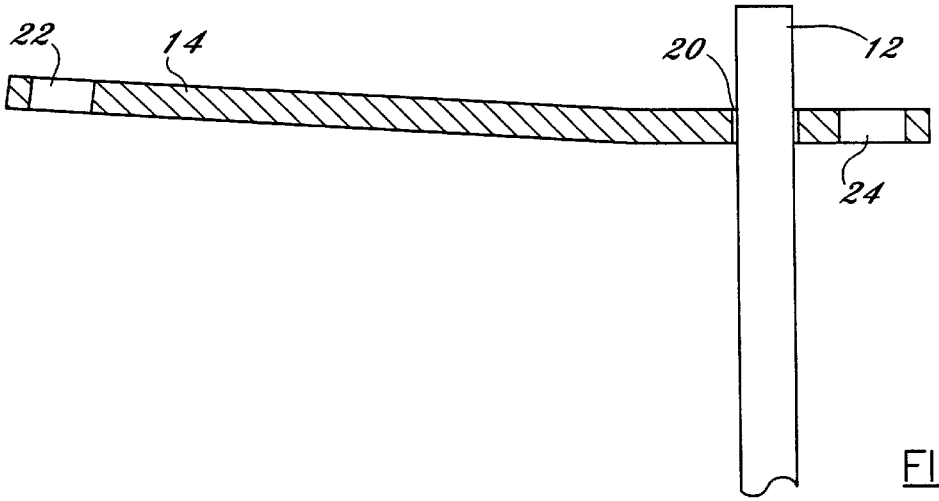
FIG. 3*a* is a partially enlarged view of a cantilever member with a pole inserted therethrough having a raised second end to allow the cantilever member to be moved relative to the pole in accordance with the present invention.
Figure 3B:
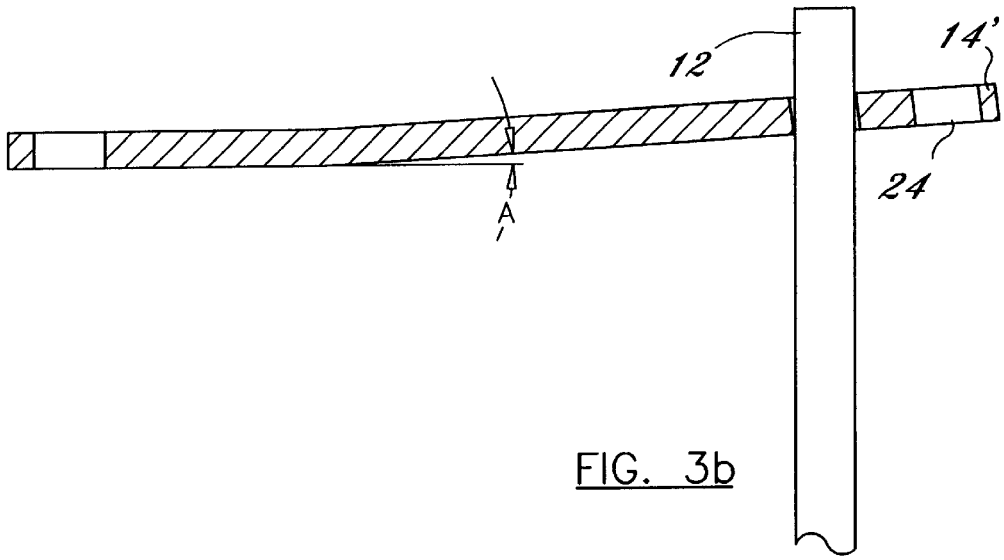
FIG. 3*b* is a partially enlarged view of a cantilever member bent at substantially a second end thereof with a pole inserted therethrough in a resting position in accordance with the present invention.
Figure 3C:
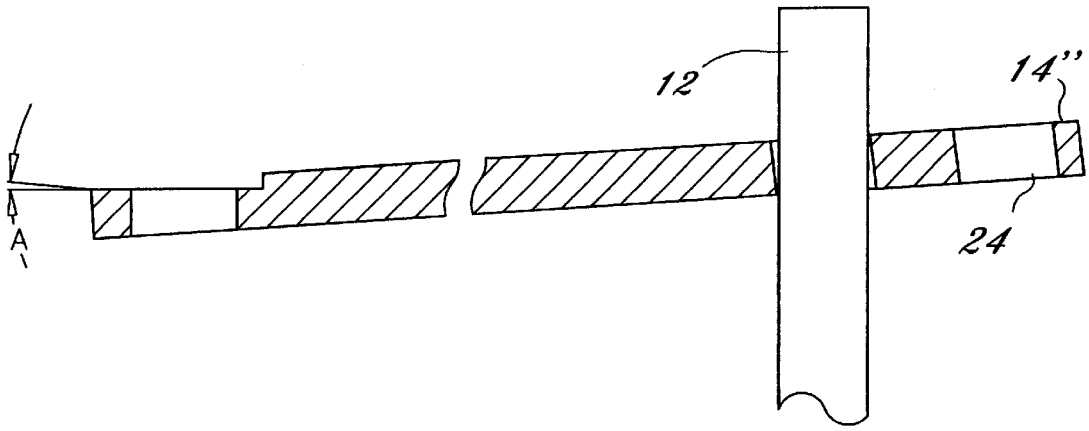
FIG. 3*c* is a partially enlarged view of a cantilever member machined at a second end thereof with a pole inserted therethrough in a resting position in accordance with the present invention.

With reference now to the drawings, and particularly to FIG. 1, there is shown a front view of the adjustable lamp 1. With reference to FIGS. 2–3*c*, the adjustable lamp 1 includes a base 10, a pole 12, a cantilever member 14, a light bulb assembly 16, and a lamp shade 18. The pole 12 preferably screws into the base 10, but may be attached thereto with other assembly methods. The pole 12 is preferably round in shape to allow rotation of the cantilever member 14, but may be any other shape such as square. A base 10 having a particular design is shown in the figures; however, the invention should not be limited to using this design of base, but the base could have any appropriate design or shape. The pole 12 may be fabricated from more than one piece to allow disassembly for shipping purposes.

A pole opening 20 is formed through substantially a first end of the cantilever member 14 and is sized to slidably receive the outer perimeter of the pole 12. The pole opening 20 may be the same shape as the pole 12 or a different shape. An assembly opening 22 is preferably formed at a second end of the cantilever member 14 to attach the light bulb assembly 16 to the cantilever member 14. A cord opening 24 is preferably formed in a first end of the cantilever member 14 for insertion of an electrical cord 32. The cantilever member 14 is preferably bent to an angle "A" in at least one place along a length thereof such that the lamp socket assembly 16 is perpendicular to the bottom of the base 10. The cantilever member 14 may also be machined at the second end such that the lamp socket assembly 16 is perpendicular to the bottom of the base 10.

The following value is given by way of example and not by way of limitation. Angle "A" preferably has the value of between 2–5 degrees. The pole opening 20 in the cantilever member 14 is made larger than the outer perimeter of the pole 12 such that the cantilever member 14 may easily be moved relative to pole 12. The weight of the lamp shade 18 and the light bulb assembly 16 is sufficient to provide frictional resistance to prevent the cantilever member 14 from sliding down the pole 12.

Figure 4:
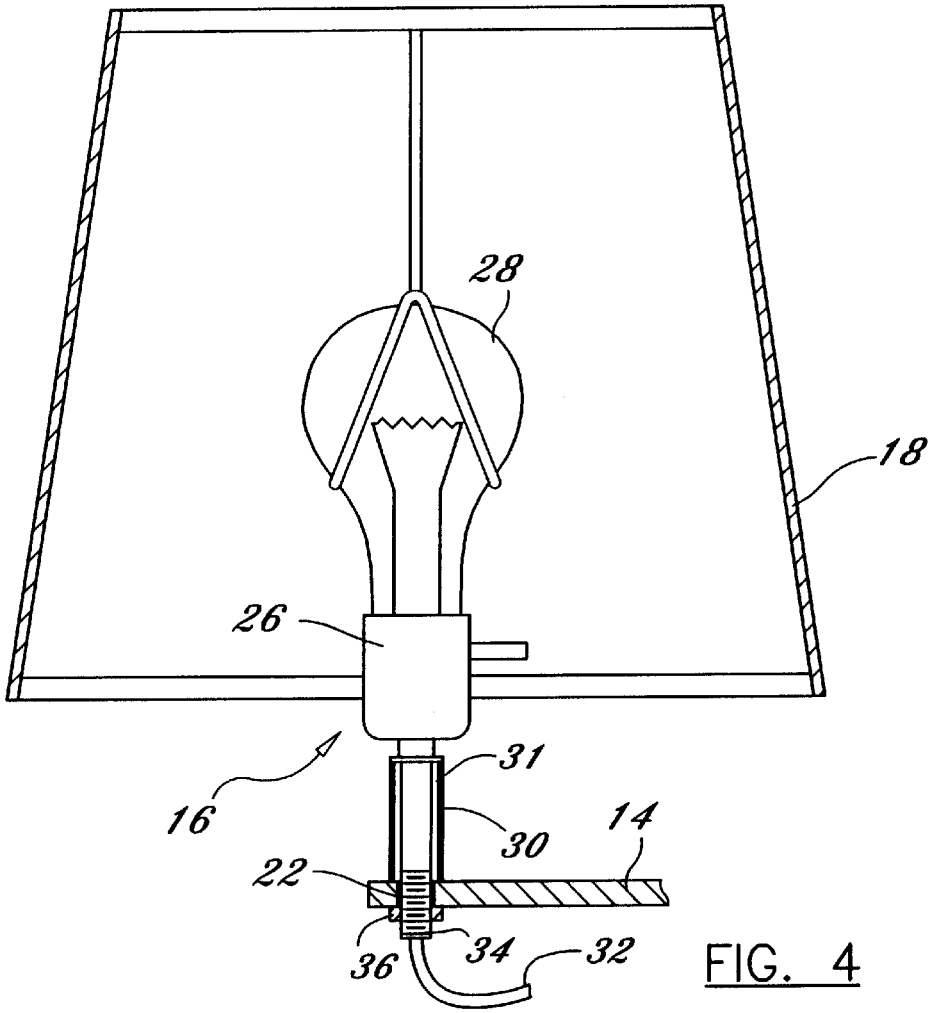
FIG. 4 is an enlarged side view of a light bulb assembly and lamp shade in accordance with the present invention.

FIG. 4 shows an enlarged side view of a light bulb assembly 16 and lamp shade 18. The light bulb assembly 16 preferably includes a light bulb socket 26, a light bulb 28, a spacer 30, and an electrical cord 32. A threaded stud 34 preferably extends from a bottom of the light bulb socket 26. The threaded stud 34 is inserted through an opening 31 formed through the spacer 30 and the threaded stud 34 is then inserted through the assembly opening 22 in the cantilever member 14. A nut 36 is screwed on to the threaded stud 34 until tight. The light bulb 28 is screwed into the light bulb socket. A lamp shade 18 is attached to the light bulb 28. The lamp shade 18 should not be limited to the type which mounts to a light bulb, but should include any lamp shade 18 which may be mounted to a light bulb socket 26 or to any other part of the adjustable lamp 1. The position of the light bulb 28 is adjusted by lifting up the cantilever member 14 from a resting position, sliding the cantilever member 14 to a desired position, and finally lowering thereof.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable lamp comprising:

a base;

a pole attached to said base;

a cantilever member having a pole opening formed therethrough at substantially a first end thereof, said opening being sized to slidably receive said pole, frictional resistance providing the only support for retaining said cantilever member relative to said pole;

a light bulb socket being attached to a second end of said cantilever member;

a light bulb being inserted into said light bulb socket; and an electrical cord supplying said light bulb with electrical power, wherein when the position of said light bulb needs to be adjusted said second end of said cantilever member being lifted up such that said cantilever member may be easily slid relative to said pole, wherein the weight of the light bulb socket, the light bulb, and the electrical cord provides the frictional resistance which prevents the cantilever member from sliding down said pole.

2. The adjustable lamp of claim 1, wherein:

said cantilever member being bent such that said light bulb socket is perpendicular with a bottom of said base when said cantilever member is in a resting position.

3. The adjustable lamp of claim 1, wherein:

said cantilever member being machined at a second end thereof such that said light bulb socket is perpendicular with a bottom of said base when said cantilever member is in a resting position.

4. The adjustable lamp of claim 1, wherein:

a cord opening being formed through said first end of said cantilever member, said electrical cord being inserted through said cord opening.

5. The adjustable lamp of claim 1, further comprising:

a spacer having an opening formed therethrough;

said light bulb socket having a threaded stud extending from a bottom thereof, an assembly opening being formed in a first end of said cantilever member, said threaded stud being inserted through said spacer, said threaded stud being inserted through said assembly opening; and a nut being screwed on said threaded stud and tightened against said cantilever member.

6. The adjustable lamp of claim 1, further comprising:

a lamp shade being attached to said adjustable lamp.

7. An adjustable lamp comprising:

a base;

a pole attached to said base;

a cantilever member having a pole opening formed therethrough at substantially a first end thereof, said opening being sized to slidably receive said pole, frictional resistance providing the only support for retaining said cantilever member relative to said pole;

a light bulb socket being attached to a second end of said cantilever member;

a light bulb being inserted into said light bulb socket;

a lamp shade being attached to said adjustable lamp; and an electrical cord supplying said light bulb with electrical power, wherein when the position of said light bulb needs to be adjusted said second end of said cantilever member being lifted up such that said cantilever member may be easily slid relative to said pole, wherein the weight of the light bulb socket, the light bulb, the lamp shade, and the electrical cord provides the frictional resistance which prevents the cantilever member from sliding down said pole.

8. The adjustable lamp of claim 7, wherein:

said cantilever member being bent such that said light bulb socket is perpendicular with a bottom of said base when said cantilever member is in a resting position.

9. The adjustable lamp of claim 7, wherein:

said cantilever member being machined at a second end thereof such that said light bulb socket is perpendicular with a bottom of said base when said cantilever member is in a resting position.

10. The adjustable lamp of claim 7, wherein:

a cord opening being formed through said first end of said cantilever member, said electrical cord being inserted through said cord opening.

11. The adjustable lamp of claim 7, further comprising:

a spacer having an opening formed therethrough;

said light bulb socket having a threaded stud extending from a bottom thereof, an assembly opening being formed in a second end of said cantilever member, said threaded stud being inserted through said spacer, said threaded stud being inserted through said assembly opening; and a nut being screwed on said threaded stud and tightened against said cantilever member.

12. An adjustable lamp comprising:

a base;

a pole attached to said base;

a cantilever member having a pole opening formed therethrough at substantially a first end thereof, said opening being sized to slidably receive said pole, an assembly opening formed in a first end of said cantilever member, frictional resistance providing the only support for retaining said cantilever member relative to said pole;

a spacer having an opening formed therethrough;

a light bulb socket having a threaded stud extending from a bottom thereof, said threaded stud being inserted through said spacer, said threaded stud being inserted through said assembly opening;

a nut being screwed on said threaded stud and tightened against said cantilever member;

a light bulb being inserted into said light bulb socket;

a lamp shade being attached to said adjustable lamp; and an electrical cord supplying said light bulb with electrical power, wherein when the position of said light bulb needs to be adjusted said second end of said cantilever member being lifted up such that said cantilever member may be easily slid relative to said pole, wherein the weight of the light bulb socket, the light bulb, the lamp shade, and the electrical cord provides the frictional resistance which prevents the cantilever member from sliding down said pole.

13. The adjustable lamp of claim 12, wherein:

said cantilever member being bent such that said light bulb socket is perpendicular with a bottom of said base when said cantilever member is in a resting position.

14. The adjustable lamp of claim 12, wherein:

said cantilever member being machined at a second end thereof such that said light bulb socket is perpendicular with a bottom of said base when said cantilever member is in a resting position.

15. The adjustable lamp of claim 12, wherein:

a cord opening being formed through said first end of said cantilever member, said electrical cord being inserted through said cord opening.

* * * * *